US012448206B2

(12) United States Patent
Onel et al.

(10) Patent No.: US 12,448,206 B2
(45) Date of Patent: Oct. 21, 2025

(54) STACKABLE RACK SYSTEM

(71) Applicant: CRYOPORT, INC., Brentwood, TN (US)

(72) Inventors: Bobby Onel, Laguna Beach, CA (US); Bret Bollinger, Yorba Linda, CA (US); Ben Lee, Corona, CA (US)

(73) Assignee: Cryoport, Inc., Brentwood, TN (US)

( * ) Notice: Subject to any disclaimer, the term of this patent is extended or adjusted under 35 U.S.C. 154(b) by 885 days.

(21) Appl. No.: 17/362,420

(22) Filed: Jun. 29, 2021

(65) Prior Publication Data

US 2022/0411176 A1 Dec. 29, 2022

(51) Int. Cl.

| | |
|---|---|
| ***A47B 47/00*** | (2006.01) |
| ***B65D 81/02*** | (2006.01) |
| ***B65D 81/38*** | (2006.01) |
| ***B65D 90/00*** | (2006.01) |

(52) U.S. Cl.

CPC ..... *B65D 90/0073* (2013.01); *A47B 47/0091* (2013.01); *B65D 81/02* (2013.01); *B65D 81/3825* (2013.01); *B65D 2590/0066* (2013.01)

(58) Field of Classification Search

CPC ..... B65D 90/0073; B65D 81/02; B65D 81/3825; B65D 2590/0066; A47B 47/0091

USPC ..... 410/46

See application file for complete search history.

(56) References Cited

U.S. PATENT DOCUMENTS 979,010 A * 12/1910 Kuffel ..... B42F 17/18 312/319.1
3,583,724 A * 6/1971 Cowlin ..... B65D 21/08 280/79.2
4,009,781 A * 3/1977 Agnew ..... G11B 23/02 220/500
4,493,417 A * 1/1985 Ackeret ..... G11B 33/0444
4,552,271 A * 11/1985 Kranz ..... A47J 47/14 294/162
RE32,753 E * 9/1988 Ackeret ..... G11B 33/0416 206/311

(Continued)

FOREIGN PATENT DOCUMENTS

CN 106586180 A 4/2017
CN 210000822 U 1/2020

(Continued)

OTHER PUBLICATIONS

PCT; International Search Report & Written Opinion dated Oct. 18, 2021 in PCT Application No. PCT/US2022/034996.

(Continued)

*Primary Examiner* — Hilary L Gutman

(74) *Attorney, Agent, or Firm* — Snell & Wilmer L.L.P.

(57) ABSTRACT

In general, one aspect of the subject matter described in this specification is embodied in a rack system. The rack system includes a first stackable rack and a second stackable rack. The first stackable rack includes a top ceiling, a bottom surface, a first sidewall and a second sidewall. The second stackable rack includes a top ceiling, a bottom surface, a first sidewall, a second sidewall and a shelf. The top ceiling, the bottom surface, the first sidewall, the second sidewall and the shelf of the second stackable rack define a first compartment and a second compartment. The bottom surface of the first stackable rack is slidably coupled with the top ceiling of the second stackable rack.

13 Claims, 6 Drawing Sheets

(56) References Cited

U.S. PATENT DOCUMENTS

| | | | | |
|---|---|---|---|---|
| 5,833,057 | A * | 11/1998 | Char | B65D 81/26 229/148 |
| D631,510 | S * | 1/2011 | Stravitz | D19/78 |
| 9,526,333 | B1 * | 12/2016 | Nielson | A47B 87/0292 |
| 2004/0028495 | A1 * | 2/2004 | Tomkins | B65D 88/121 410/46 |
| 2006/0207957 | A1 * | 9/2006 | Chen | A47B 47/0066 211/183 |
| 2010/0191615 | A1 * | 7/2010 | Thomas | B65D 90/008 52/27 |
| 2015/0076095 | A1 * | 3/2015 | Clark | A47B 47/0091 211/183 |
| 2015/0239640 | A1 * | 8/2015 | Smith | B65D 43/162 220/592.2 |
| 2016/0023833 | A1 * | 1/2016 | Hallab | B65D 81/022 220/592.27 |
| 2016/0095429 | A1 * | 4/2016 | Miranda | A47B 47/0091 312/265.5 |
| 2019/0168913 | A1 * | 6/2019 | Brantley | A47B 61/04 |

FOREIGN PATENT DOCUMENTS

| | | | | |
|---|---|---|---|---|
| CN | 211520296 | U | 9/2020 | |
| EE | 00608 | U1 * | 2/2006 | |
| FR | 2848789 | A1 * | 6/2004 | A45C 11/008 |
| JP | H0533292 | U * | 4/1993 | |
| JP | H1130175 | A | 11/1999 | |
| JP | 2001144158 | A | 5/2001 | |

OTHER PUBLICATIONS

PCT; International Preliminary Report on Patentability dated Jan. 11, 2024 for Application No. PCT/US2022/034996.

* cited by examiner

STACKABLE RACK SYSTEM

BACKGROUND

1. Field

This specification relates to a system, apparatus and/or a method to provide a versatile and stackable storage rack system for a shipping container.

2. Description of the Related Art

The transportation of temperature-sensitive materials, such as biological tissues and blood samples, requires specialized handling with shipping containers, storage receptacles and racks. These materials are first transferred into a primary receptacle, such as a vial or blood bag. The vials and blood bags are then placed inside a secondary receptacle, such as a vial box or blood cassette. Next, the secondary receptacles are stored inside a storage rack, which goes directly into a shipping container for shipment. The storage racks are designed to compartmentalize the secondary receptacles while limiting their movement inside to reduce the impact of external forces on the secondary receptacles. Because secondary receptacles are different in size and/or shape, the storage racks carrying them are designed to accommodate those differences. As a result, storage racks for different secondary receptacles have to be placed inside separate shipping containers, although there is adequate storage space in a single shipping container. This leads to inconvenience and logistics issues when a combination of different secondary receptacles need to be shipped. One possible solution is a custom-design storage rack that can carry a fixed number of different secondary receptacles. However, given the variety of shipping needs for secondary receptacles, a small number of custom-design storage racks are not enough to meet the demand. On the other hand, too many custom-design storage racks may create inventory management issues.

Accordingly, there is a need for a system, apparatus and/or method to provide a versatile and stackable storage rack system for a shipping container.

SUMMARY

In general, one aspect of the subject matter described in this specification is embodied in a rack system. The rack system includes a first stackable rack and a second stackable rack. The first stackable rack includes a top ceiling, a bottom surface, a first sidewall and a second sidewall. The second stackable rack includes a top ceiling, a bottom surface, a first sidewall, a second sidewall and a shelf. The top ceiling, bottom surface, first sidewall, second sidewall and shelf of the second stackable rack define a first compartment and a second compartment. The bottom surface of the first stackable rack slidably connects with the top ceiling of the second stackable rack.

These and other embodiments may optionally include one or more other features. The bottom surface of the first stackable rack and the top ceiling of the second stackable rack may include a channel and a rail, respectively. The rail may be slidably received within the channel to interconnect the bottom surface of the first stackable rack and the top ceiling of the second stackable rack. The first stackable rack may have a first size and a first shape and the second stackable rack may have a second size and a second shape. The first size or first shape may be different than or same as the second size or second shape, respectively. The first or second stackable rack may include a material resistant to cold temperature.

The first or second compartment of the second stackable rack may receive a storage container through an opening of the first or second compartment. The storage container may include a vial box or a cassette. The storage container may store a liquid and be placed flatly and horizontally on the shelf.

The rack system may further include a damping device positioned within the first or second compartment of the second stackable rack. The damping device may be configured to reduce vibration of a storage container received within the first or second compartment when the storage container is inserted into the first or second compartment through an opening of the first or second compartment. The damping device may include a leaf spring. The leaf spring may be coupled to the shelf or the bottom surface of the second stackable rack and include a curved elongated portion that protrudes or curves into the first or second compartment and flexes or compresses to reduce the vibration. The damping device may be further configured to secure the storage container within the first or second compartment.

The shelf may be configured to be inserted into and removed from the second stackable rack. The shelf may be coupled in between the first sidewall and second sidewall at various positions to adjust a size of the first or second compartment. The second stackable rack may further include a rear wall that extends between the top ceiling and bottom surface. The rear wall may include at least one uncovered portion through which a storage container received within the first or second compartment is pushed out of the first or second compartment.

In another aspect, the subject matter may be embodied in a stackable rack. The stackable rack may include a top ceiling, a bottom surface, a first sidewall, a second sidewall and a shelf. The top ceiling, bottom surface, first sidewall, second sidewall and shelf may define a first compartment and a second compartment. The top ceiling or bottom surface may include a rail or a channel that interconnects with a channel or a rail, respectively, of another stackable rack.

In another aspect, the subject matter may be embodied in a stackable rack. The stackable rack may include a top ceiling, a bottom surface, a first sidewall, a second sidewall, a shelf and a damping device. The top ceiling, bottom surface, first sidewall, second sidewall and shelf may define a first compartment and a second compartment. The damping device may be positioned within the first or second compartment and configured to reduce vibration of a storage container received within the first or second compartment when the storage container is inserted into the first or second compartment through an opening of the first or second compartment.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are systems, devices and/or methods to provide a versatile and stackable storage rack system for a shipping container. A stackable rack stores storage receptacles, such as a vial box, a cassette, and/or other storage container (hereinafter referred to as a "storage container"). A rack system may include two or more stackable racks coupled together. The two or more stackable racks may be of different sizes and/or have multiple compartments that are of different sizes to receive one or more storage containers. The storage containers may be of different sizes and have different purposes. Thus, the rack system may include a combination of a number of different stackable racks depending on the amount of storage containers that need to be shipped, which provides flexibility and convenience for shipment handling by minimizing the amount of shipping containers needed. Each stackable rack within the rack system may be modularly interconnected so that the entire rack system may be removed, one of the stackable racks within the rack system may be removed or interchanged, and the remaining stackable racks may be reconnected. The removed stackable rack may then be placed in a dewar, which increases the speed or efficiency of the transfer process from a stackable rack in the storage tank to the dewar.

The rack system's other benefits and advantages include that a shelf may be inserted into and removed from a stackable rack and coupled in between the multiple walls of the stackable rack at various positions to adjust a size of one or more storage compartments to accommodate storage containers of different sizes and shapes. Furthermore, the shelves of the two stackable racks may be adjusted so that each individual stackable rack may provide storage compartments for a different type of storage container. Thus, the rack system may provide versatility for shipment handling by storing different types of storage containers on the shelves of the same rack or different racks.

The rack system may further include a damping device positioned within the one or more storage compartments of a stackable rack to reduce vibration of a storage container received within the one or more storage compartments when the storage container is inserted into the one or more storage compartments through an opening. The damping device may be a leaf spring coupled to the shelf. The leaf spring may include a curved elongated portion that protrudes or curves into the one or more storage compartments and flexes or compresses to reduce the vibration. Thus, the rack system may protect the storage containers from external impact and secure them inside the rack during shipment using the damping device.

Figure 1A:
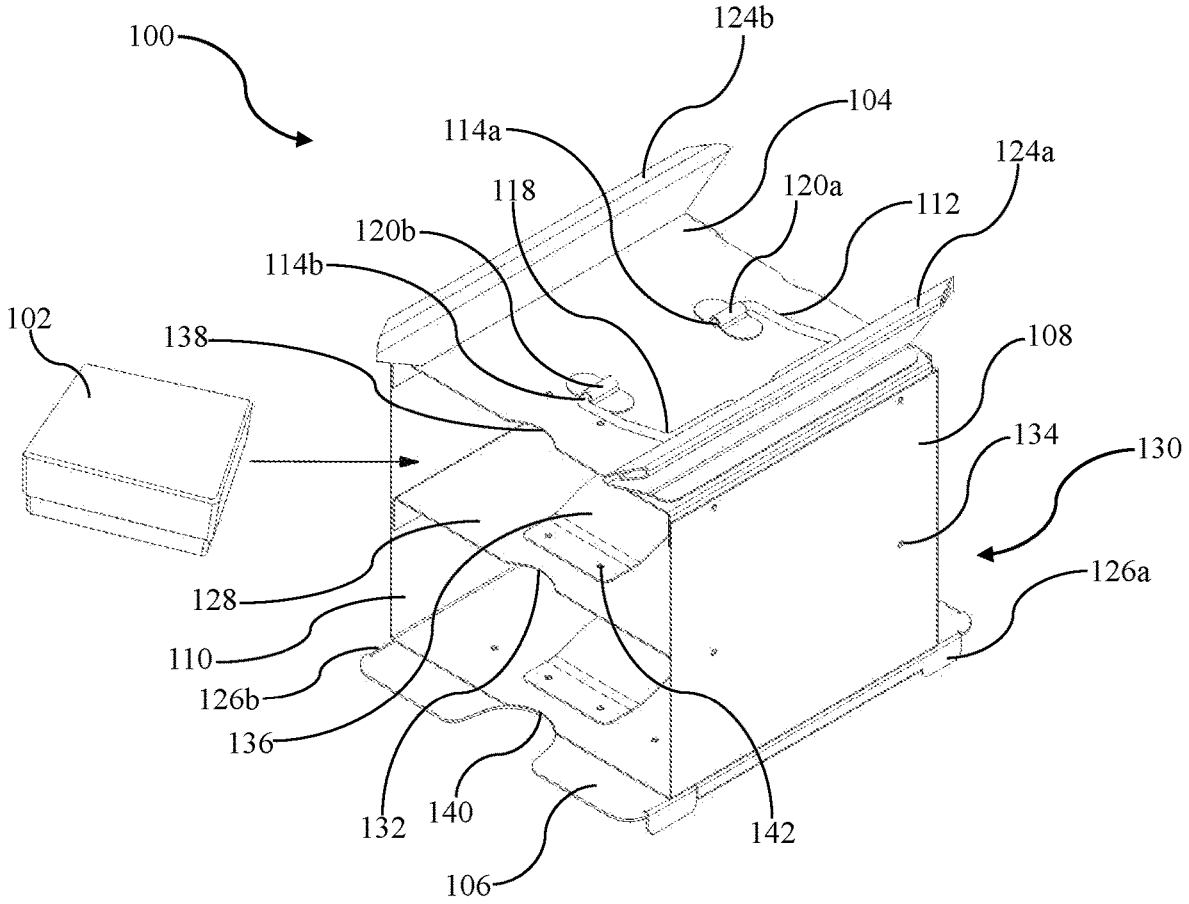
FIG. 1A shows an example of a stackable rack according to an aspect of the invention.
Figure 1B:
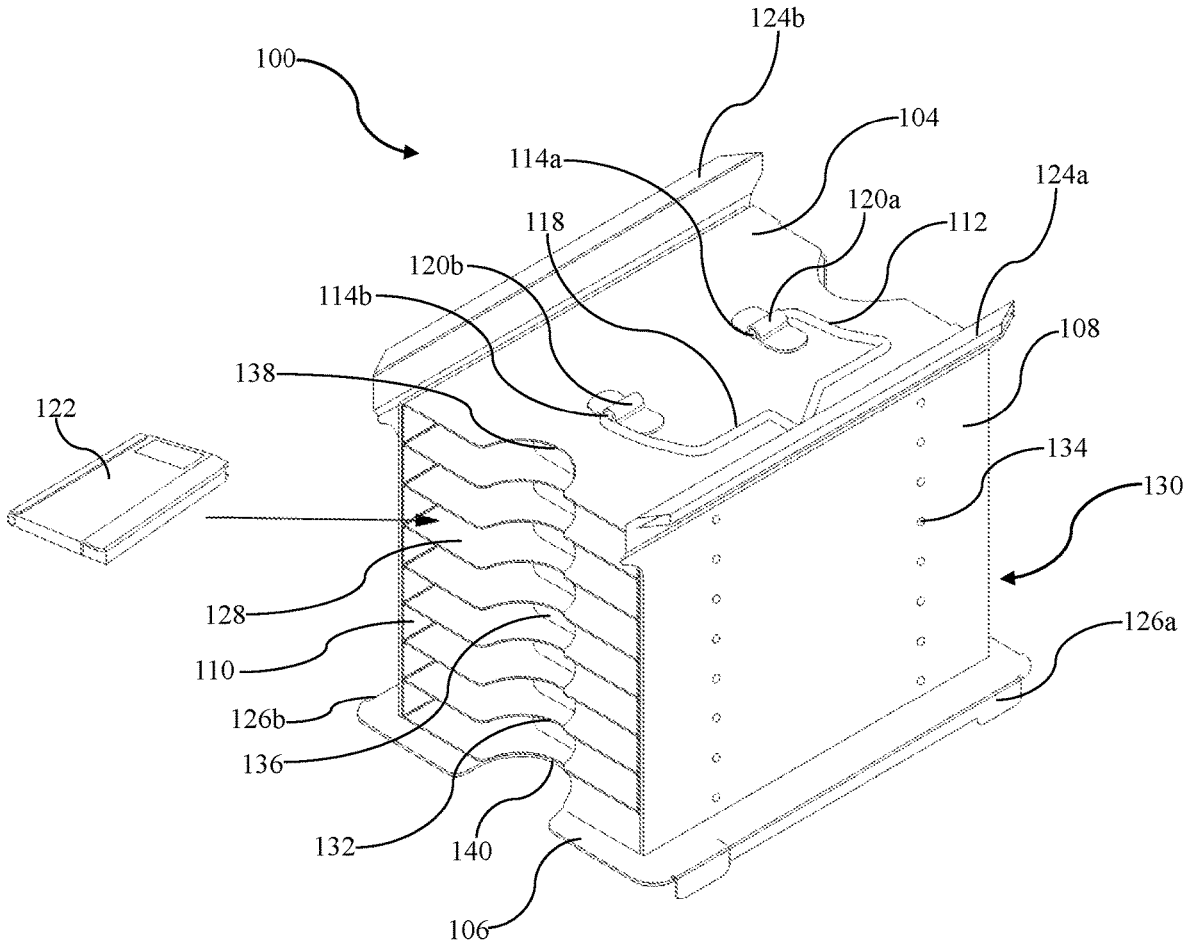
FIG. 1B shows another example of a stackable rack according to another aspect of the invention.

FIG. 1A shows a stackable rack 100 that stores a vial box 102. The stackable rack 100 may store the vial box 102, or a cassette 122 as shown in FIG. 1B, for example, and/or other storage containers. The stackable rack 100 may be placed inside a shipping container for transportation. The inside of the shipping container may be maintained at a cold or cryogenic temperature. The cold or cryogenic temperature may be in the range of approximately −200° C. to 20° C. The stackable rack 100 may be made from a metallic or non-metallic material, such as a polycarbonate, that is resistant to cryogenic temperatures.

The stackable rack 100 may include multiple walls. The multiple walls may include a top ceiling 104, a bottom surface 106, a first sidewall 108 and a second sidewall 110. The top ceiling 104 and bottom surface 106 may be opposite each other, and the first sidewall 108 and second sidewall 110 may be opposite each other and positioned in between the top ceiling 104 and the bottom surface 106 to form an inner enclosure. The inner enclosure may have any number of compartments, e.g., the inner enclosure may have up to five compartments to hold five standard vial boxes, as described below. In some implementations, the stackable rack 100 may have a rear wall or plating 130. The rear wall or plating 130 may be slidably received or coupled to the back of the stackable rack 100 so that a storage container placed inside the stackable rack 100 does not slide or move out of the one or more compartments.

The stackable rack 100 may include a handle 112 coupled to the top ceiling 104. The handle 112 may allow a user to pull the entire stackable rack 100 and/or rack system out and remove or disconnect a specific stackable rack 100 from the entire rack system and then reconnect the remaining stackable racks 100 within the rack system. The handle 112 may include a handle bar 118 that may be held to lift and/or move the stackable rack 100. The handle 112 may include one or more connecting devices, such as a first pin 114*a* and a second pin 114*b* that are integrally formed with the handle bar 118, which may couple or interconnect with the top ceiling 104 via one or more connectors 120*a* and 120*b*.

The handle bar 118 may be U-shaped, V-shaped or form any other shape. The one or more connecting devices may be one or more pins 114*a* and 114*b*, protrusions, latches or any other connecting or fastening device. The one or more connecting devices may be integrally formed, coupled or otherwise included or connected to the handle bar 118. For example, the first pin 114*a* and the second pin 114*b* may both be integrally formed with the handle bar 118 and be inserted into, received into or otherwise coupled to the one or more connectors 120*a* and 120*b* and be positioned horizontally on the top ceiling 104. The first pin 114*a* and second pin 114*b* may be opposite and aligned with each other and interconnected with the handle bar 118 in between. The handle bar 118 may include a V-shaped portion with a vertex that is perpendicular to and in contact with the top ceiling 104 so that the handle bar 118 is largely above the top ceiling 104 allowing the stackable rack 100 to be lifted or held using the handle 112.

The handle 112 may be coupled to the top ceiling 104 via a connector. For example, the top ceiling 104 may include one or more connectors that couple the handle 112 to the top ceiling 104. The one or more connectors may include a first connector 120*a* and a second connector 120*b* both of which are coupled to the top ceiling 104 and aligned with each other. The first connector 120*a* and second connector 120*b* may be barrel latches and may each include two flat side pieces and one curved center piece. The curved center piece may form a hollow barrel above the top ceiling 104. The hollow barrel may receive the first pin 114*a* and/or the second pin 114*b* to fasten, connect or otherwise couple the handle bar 118 with the top ceiling 104 through the two side pieces. The barrels of the first and second connectors 120*a* and 120*b* may be aligned with each other. A portion or all of the first pin 114*a* and second pin 114*b* of the handle bar 118 may be inserted into and/or received within the barrels of the first connector 120*a* and/or second connector 120*b*, respectively, to couple the handle 112 to the top ceiling 104. The first pin 114*a* and second pin 114*b* may rotate inside the barrels of the first connector 120*a* and second connector 120*b* to allow the handle 112 to move pivotally around the axis formed by the first pin 114*a* and second pin 114*b*.

The stackable rack 100 may include one or more interlocking devices, such as one or more channels, such as a first channel 124*a* and a second channel 124*b*, and/or one or more rails, such as a first rail 126*a* and a second rail 126*b*, or other interlocking devices. The one or more other interlocking devices may include a pin that is received within a pinhole or a magnetic connection that has different polarizations that attract. The one or more interlocking devices may include a first interlocking device located on the top ceiling 104 of the stackable rack 100 that interlocks with a corresponding interlocking device located on a bottom surface of a second stackable rack to interconnect the stackable rack 100 with the second stackable rack to form a rack system. Moreover, the one or more interlocking devices may include a second interlocking device located on the bottom surface 106 of the stackable rack 100 that interlocks with a corresponding interlocking device located on a top ceiling of a third stackable rack to interconnect the stackable rack 100 with the third stackable rack to form a rack system. For example, the one or more channels 124*a* and 124*b* on one stackable rack may slidably receive the corresponding one or more rails 126*a* and 126*b* on another stackable rack to couple the two stackable racks together.

The one or more interlocking devices may be located close to or on an edge of the top ceiling 104 above the first sidewall 108 and/or the second sidewall 110, and/or may be located close to or on an edge of the bottom surface 106 below the first sidewall 108 and/or the second sidewall 110. For example, a first channel 124*a* may be positioned at the edge of the top ceiling 104 above the first sidewall 108 and a second channel 124*b* may be positioned at the edge of the top ceiling 104 above the second sidewall 110. A first rail 126*a* may be positioned at the edge of the bottom surface 106 below the first sidewall 108 and a second rail 126*b* may be positioned at the edge of the bottom surface 106 below the second sidewall 110. Each of the first rail 126*a* and second rail 126*b* are shown in FIG. 1B. FIG. 1B depicts a bottom surface 106 with a first portion extending laterally outward past the first sidewall 108 toward the viewer. FIG. 1B also depicts a bottom surface 106 with a second portion extending laterally outward past the second sidewall 110 away from the viewer. The entire bottom surface 106 is shown as one continuous piece of material shaped like a plane. This characteristic evident in FIG. 1B could be briefly described by saying the bottom surface is a single planar and continuous piece. The first rail 126*a* is shown as a flange that bends from the edge of bottom surface 106 that is toward the viewer. The second rail 126*b* is shown as a flange that bends from the edge of bottom surface 106 that is away from the viewer. Reference number 126*a* is drawn pointing to the flange feature. Each flange has a portion that extends more than the rest of the flange. These are shown also and reference number 126*a* is pointing most specifically to one of these portions that extends more than the rest of the flange. One useful word to refer to this portion in contrast to referring to the entire flange is the word "tab." Thus, one can see in FIG. 1B that a rail (rails 126*a*, 126*b*) has a pair of tabs that extend down from the flange of the rail. In some implementations, the one or more channels 124*a* and 124*b* may be positioned on another location on the top ceiling 104, such as at a central location on the top ceiling 104 equidistant between the two corner edges where the first sidewall 108 and second sidewall 110 couple to the top ceiling 104. The one or more rails 126*a* and 126*b* may be positioned on another location on the bottom surface 106, such as at a central location on the bottom surface 106 equidistant between the two corner edges where the first sidewall 108 and second sidewall 110 couple to the bottom surface 106.

In another example, the first channel 124*a* may be positioned at the edge of the bottom surface 106 below the first sidewall 108 and the second channel 124*b* may be positioned at the edge of the bottom surface 106 below the second sidewall 110. The first rail 126*a* may be positioned at the edge of the top ceiling 104 above the first sidewall 108 and the second rail 126*b* may be positioned at the edge of the top ceiling 104 above the second sidewall 110. In some implementations, the one or more channels 124 may be positioned on another location on the bottom surface 106, such as at a central location on the bottom surface 106. Moreover, the one or more rails 126 may be positioned on another location on the top ceiling 104, such as at a central location on the top ceiling 104.

In some implementations, the one or more interlocking devices may include one channel and one rail located on the top ceiling 104 or bottom surface 106 of the stackable rack 100. In one exemplary embodiment, the one or more interlocking devices may include a channel and a rail located on the top ceiling 104 of the stackable rack 100, which may interlock with a rail and a channel located on a bottom surface of another stackable rack to couple the stackable rack 100 and the another stackable rack. In another exemplary embodiment, the one or more interlocking devices may include a channel and a rail located on the bottom surface 106 of the stackable rack 100, which may interlock with a rail and a channel located on a top ceiling of another stackable rack to couple the stackable rack 100 and the another stackable rack.

The stackable rack 100 may include one or more shelves 128. The top ceiling 104, bottom surface 106, first sidewall 108, second sidewall 110 and the one or more shelves 128 may form two or more enclosures or compartments. For example, a shelf 128 may be coupled, connected or integrally formed with the first sidewall 108 and the second sidewall 110 to define a first compartment and a second compartment. The first compartment may have one size or shape and the second compartment may have another size or shape. For example, the first compartment may have a height, such as between the top ceiling 104 and the bottom surface 106, a width, such as between two sidewalls 108, 110 and a depth, such as between the front opening and the rear wall 130, of slightly greater than 2 inches, 5 inches and 5 inches, respectively, to receive the vial box 102, as shown in FIG. 1A, for example, or a height, a width and a depth of slightly greater than 0.5 inch, 11 inches and 6.5 inches, respectively, to receive the cassette 122, as shown in FIG. 1B, for example.

The size or shape of the first compartment may be different than or same as the size or shape of the second compartment, respectively, such as when the shelf 128 is placed equidistant between the top ceiling 104 and the bottom surface 106. The shelf 128 may include an indentation 132 on an edge of the shelf 128 located at an opening of the first or second compartment through which a storage container is inserted and/or removed from the first or second compartment. The indentation 132 may be recessed inward into the first or second compartment. And so, when a storage container is inserted into the first or second compartment, a portion of the storage container is exposed and not covered by the surface of the shelf 128. The uncovered or exposed portion of the storage container may allow for the removal of the storage container from the first or second compartment by holding or grasping the storage container at the uncovered or exposed portion and pulling or moving the storage container out of the first or second compartment. The top ceiling 104 and/or the bottom surface 106 may similarly include an indentation, such as the indentions 138 and 140, respectively, that may be located on their edges and may be recessed inward. The indentation 138 or 140 may similarly form an uncovered or exposed portion when the storage container is inserted into the first or second compartment intent. This allows the storage container to be similarly removed from the first or second compartment by holding the storage container at the exposed or uncovered portion and pulling or moving the storage container out of the first or second compartment.

The shelf 128 may be coupled to the stackable rack 100. The shelf 128 may be coupled to, connected to and/or integrally formed with the first sidewall 108 and/or second sidewall 110. For example, the shelf 128 may be coupled to the stackable rack 100 through a fastener 134. The fastener 134 may include a bolt, a screw, a pin, a clamp, a nut, or a variant of thereof. The fastener 134 may be located on at least one of the first sidewall 108 and second sidewall 110. The shelf 128 may be coupled to at least one of the first sidewall 108 and second sidewall 110 through at least two fasteners. The at least two fasteners may be inserted into or coupled to the shelf 128 through at least one of the first sidewall 108 and second sidewall 110.

The one or more shelves 128 may be inserted into and/or removed from the stackable rack 100 at different heights and/or various positions. By inserting the one or more shelves 128 at different heights, a person may adjust the size or height of the different compartments of the stackable rack 100. For example, the size of the first or second compartment may include a height, a width, and a depth that have measurements that allow the first or second compartment to store a storage container requiring a storage space of a certain size, such as the vial box 102, the cassette 122, or another storage container. The size or height of the first or second compartment may be adjusted by coupling the shelf 128 to the stackable rack 100 at one of the different heights and/or various positions to accommodate the storage container. The various positions may be located on at least one of the first sidewall 108 and second sidewall 110 and may be evenly or unevenly spaced apart on the first sidewall 108 and/or second sidewall 110.

The stackable rack 100 may further include a rear wall 130. The rear wall 130 may be opposite the opening of the first or second compartment and extend between the top ceiling 104 and bottom surface 106. The rear wall 130, top ceiling 104, bottom surface 106, first sidewall 108 and second sidewall 110 may form an enclosure. The rear wall 130, top ceiling 104, bottom surface 106, first sidewall 108, second sidewall 110 and the one or more shelves 128 may form two or more enclosures defining the multiple compartments. The rear wall 130 may cover all or a portion of the space between the top ceiling 104 and the bottom surface 106. The rear wall 130 may include an uncovered portion through which a storage container received within one of the compartments may be pushed out and/or otherwise removed through the back of the stackable rack 100. The uncovered portion may be located in any part of the rear wall 130, such as the center or side of the rear wall 130, and may extend from the top ceiling 104 to the bottom surface 106 or a portion of thereof. The uncovered portion may extend from the first sidewall 108 to the second sidewall 110 or a portion of thereof.

Figure 2:
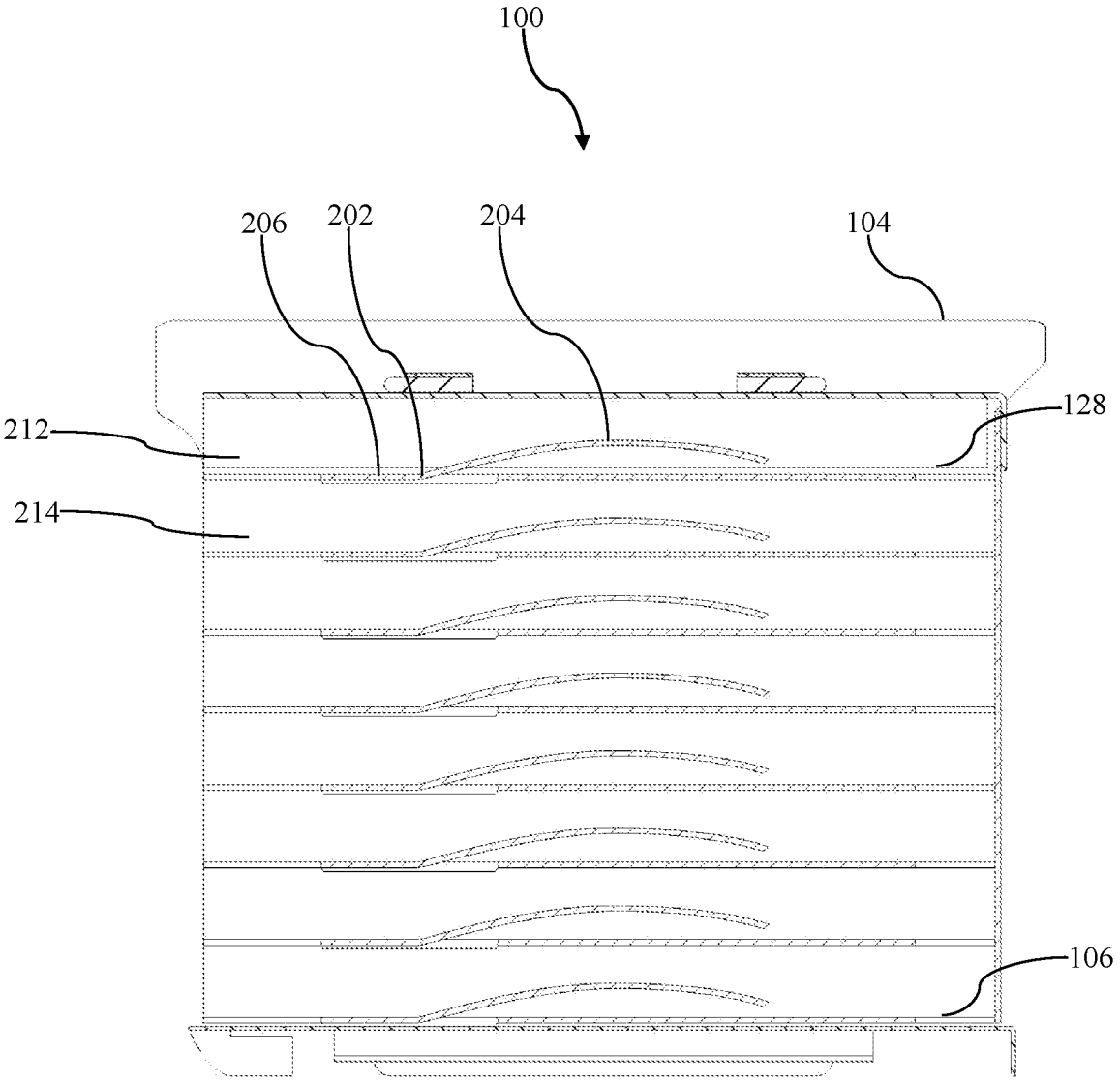
FIG. 2 shows a cross-sectional view of the stackable rack of FIG. 1A or 1B according to an aspect of the invention.

The stackable rack 100 may include one or more damping devices 136. A damping device 136 may be a leaf spring or other device that minimizes shocks, vibrations and/or movement of the storage container inserted into and stored within the one or more compartments. The damping device 136 may be positioned within at least one of the one or more compartments of the stackable rack 100. The damping device 136 may be coupled to or integrally formed within the shelf 128 and/or bottom surface 106 of the stackable rack 100. For example, the damping device 136 may be coupled to the shelf 128 via a fastener 142. The fastener 142 may include a bolt, a screw, a pin, a clamp, a nut, or a variant of thereof. FIG. 2 further illustrates the damping device 136 as described in detail below.

In another aspect, the stackable rack 100 may have a different size and store a different storage container, such as one or more cassettes 122, as shown in FIG. 1B for example. The one or more cassettes 122 may be a blood cassette. A blood cassette may store a blood bag that is placed horizontally and flatly inside the cassette 122 so that shocks and vibrations may be displaced and/or distributed across the planar surface of the shelf 128 or bottom surface 106 of the stackable rack 100. The stackable rack 100 that stores the one or more cassettes 122 may have similar components as the stackable rack 100 that stores the one or more vial boxes 102. For example, the stackable rack 100 that stores the one or more cassettes 122 may have a top ceiling 104, a bottom surface 106, a first sidewall 108, a second sidewall 110, a handle 112 coupled to the top ceiling 104, one or more channels 124, one or more rails 126, one or more shelves 128, one or more damping devices 136 and/or other similar components described above in reference to the stackable rack 100 that stores the one or more vial boxes 102. The stackable rack 100 that stores the one or more cassettes 122, however, may have one or more compartments that are sized or shaped differently than the compartments of the stackable rack 100 that stores the one or more vial boxes 102.

FIG. 2 shows a cross-sectional view of the stackable rack 100. The stackable rack 100 may have a damping device 136, such as a leaf spring 202. The damping device 136 may be coupled to, fastened to, or integrally formed with one or more shelves 128 and/or the bottom surface 106. The damping device 136 may protrude upward from the planar surface of the one or more shelves 128 and/or the bottom surface 106 and into the one or more compartments, such as the first compartment 212 and/or the second compartment 214. For example, the damping device 136 may be a leaf spring 202. Each of the one or more compartments that are formed or defined by the walls of the stackable rack and/or the one or more shelves may include a damping device 136. In some implementations, the damping device 136 is in some but not all of the compartments within the stackable rack 100.

The leaf spring 202 may be coupled to the one or more shelves 128 and/or the bottom surface 106 of the stackable rack 100. The leaf spring 202 may have a curved elongated portion 204 and/or a flat portion 206. The flat portion 206 may be proximal to the opening of the compartment and embedded within and/or flush with the shelf 128 and/or the bottom surface 106 so that the storage container may slide across the flat portion 206 and onto the curved elongated portion 204 when the storage container is inserted into the compartment. In some implementations, the flat portion 206 may be integrally formed with and/or coupled to the shelf 128 and/or the bottom surface 106 via a fastener 142. The flat portion 206 may be integrally formed with the curved elongated portion 204.

The leaf spring 202 may have a curved elongated portion 204. The curved elongated portion 204 may be distal of the flat portion 206 and may protrude or curve upward into the compartment. The curved elongated portion 204 may flex or compress when a storage container is inserted into the compartment and exerts a downward force against the leaf spring 202, which may apply an opposite upward force to reduce vibration of the storage container and hold and/or secure the storage container within the compartment.

The damping device 136 may contact the storage container and reduce vibration of the storage container that is received within the compartment. The damping device 136 may function to secure the storage container within the compartment, and may prevent the storage container from sliding out of or otherwise moving out of the compartment upon external impact or other movement to the stackable rack 100. The damping device 136 may be made from a flexible or compressible material or be coupled to or formed with the one or more shelves 128 and/or bottom surface 106 in a manner that absorbs movement vibrations of the storage container within the compartment.

When the storage container is placed flatly and horizontally inside the compartment, the damping device 136 may be in contact with a surface of the storage container, such as the vial box 102 or the cassette 122, to hold the storage container in suspension. The damping device 136 may restrain or limit movement of the storage container through the contact between the damping device 136 and the surface of the storage container. The physical contact between the damping device 136 and the storage container may generate friction that may prevent the storage container from sliding or moving out of the compartment.

Figure 3:
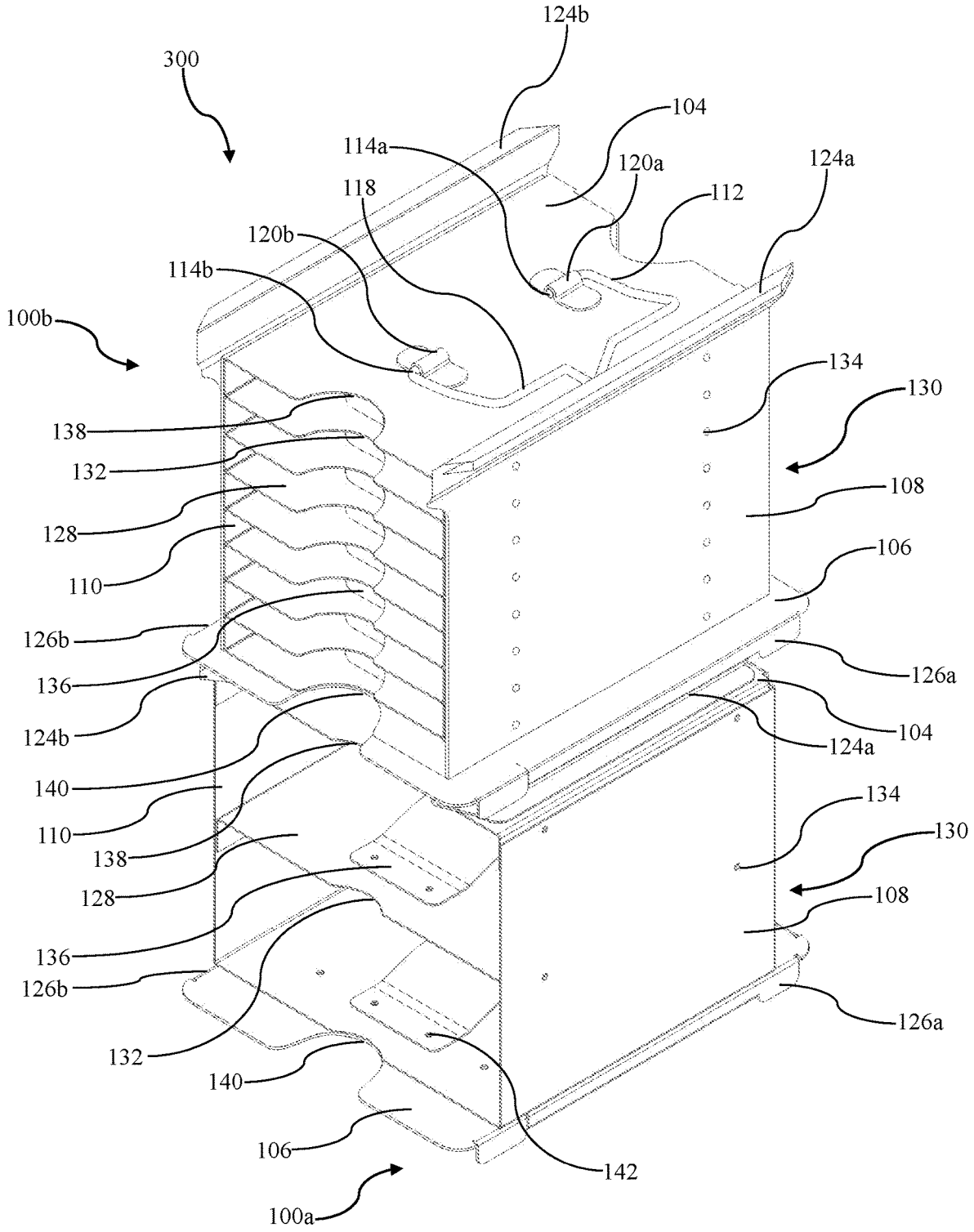
FIG. 3 shows an example of a rack system with two different stackable racks stacked on top of each other, such as the stackable racks of FIGS. 1A and 1B according to an aspect of the invention.

FIG. 3 shows a rack system 300. The rack system 300 may include one or more stackable racks 100 disclosed herein, or couple together two or more stackable racks 100 disclosed herein including a first stackable rack 100*a*, a second stackable rack 100*b* and/or any number of stackable racks. The two or more stackable racks 100 may be coupled together via one or more interlocking devices. The two or more stackable racks 100 may be of different sizes and/or shapes. For example, the rack system 300 may have and/or couple together a first stackable rack 100*a* and/or a second stackable rack 100*b*. The first stackable rack 100*a* may be a stackable rack 100 that receives, stores and/or secures one or more vial boxes 102. The second stackable rack 100*b* may be different than the stackable rack 100*a* and may be a stackable rack 100 that receives, stores and/or secures one or more cassettes 122. The second stackable rack 100*b* may have compartments that are sized and/or shaped differently than the first stackable rack 100*a*, as shown in FIG. 3 for example.

Figure 4:
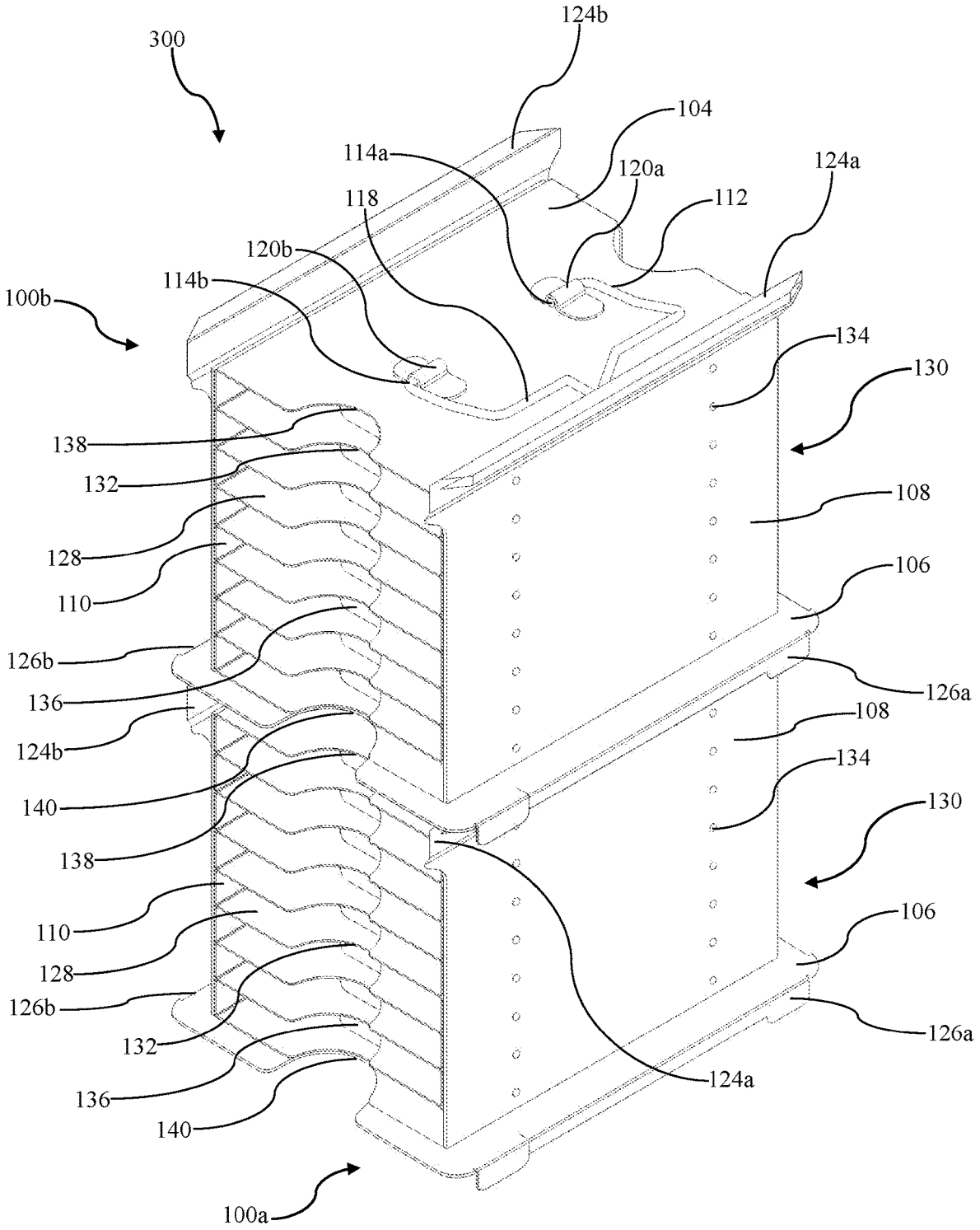
FIG. 4 shows an example of a rack system with two stackable racks that both store cassettes according to an aspect of the invention.
Figure 5:
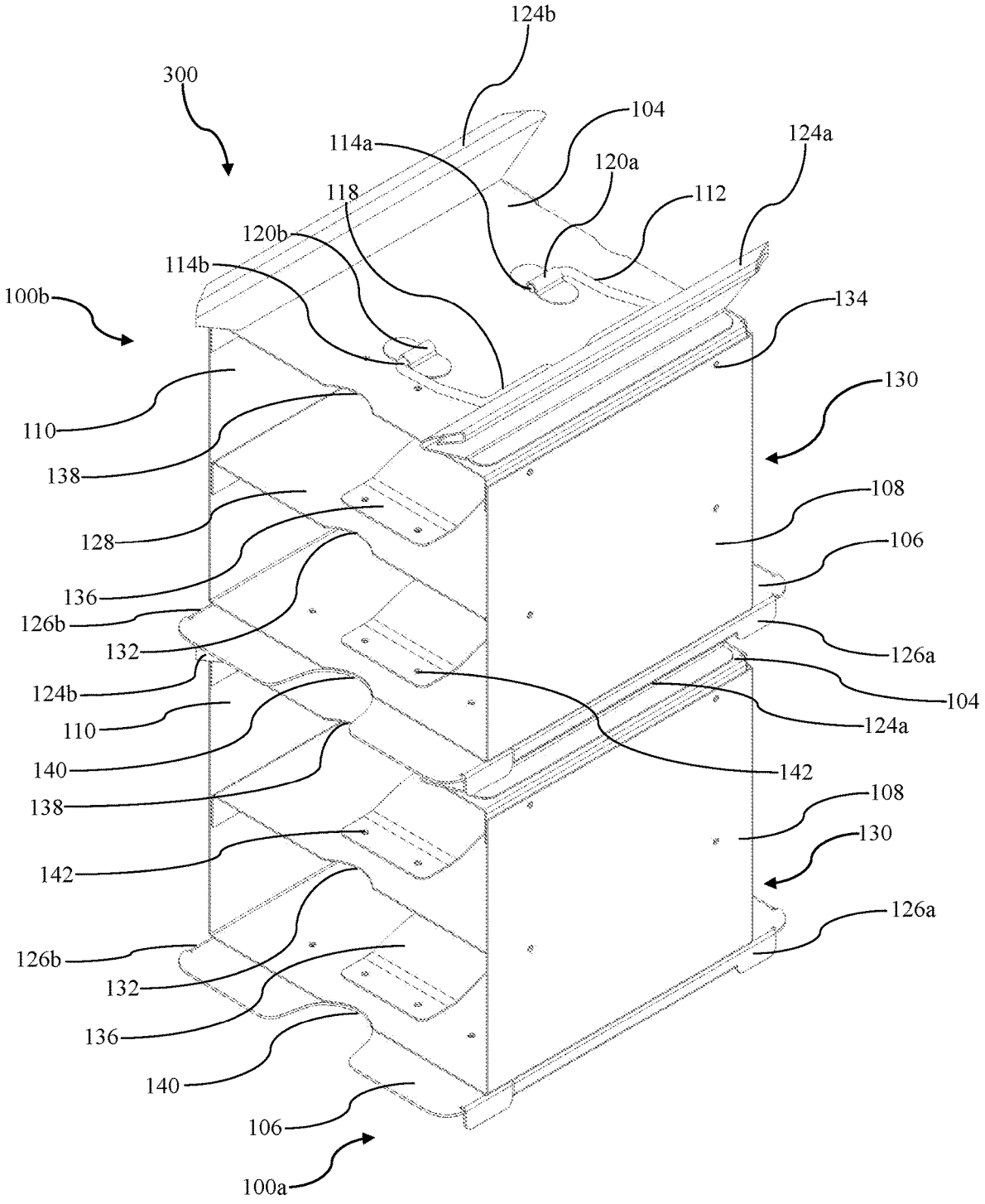
FIG. 5 shows an example of a rack system with two stackable racks that both store vial boxes according to an aspect of the invention.

In some implementations, the first stackable rack 100*a* and the second stackable rack 100*b* may be of the same size and/or shape. For example, the first stackable rack 100*a* and the second stackable rack 100*b* may both be a stackable rack 100 that receives, stores and/or secures the one or more cassettes 122, as shown in FIG. 4 for example. In another example, the first stackable rack 100*a* and the second stackable rack 100*b* may both be a stackable rack 100 that receives, stores and/or secures the one or more vial boxes 102, as shown in FIG. 5 for example. Any number of stackable racks using any number of combinations of stackable racks 100 that receive, store and/or secure either the one or more vial boxes 102 and/or cassettes 122 may be coupled to and positioned on top of each other via the one or more interlocking devices.

In order to couple together two or more stackable racks 100 via two or more interlocking devices, the one or more interlocking devices of one stackable rack 100, such as the first stackable rack 100*a*, may couple or connect to one or more corresponding interlocking devices of another stackable rack, such as the second stackable rack 100*b*. For example a channel of one stackable rack may slidably receive a rail of another stackable rack to couple the two stackable racks together to form the rack system.

For example, as shown in FIG. 3, the first stackable rack 100*a* and/or the second stackable rack 100*b* may each have one or more channels 124*a* and 124*b* positioned on the top ceilings 104 of the first stackable rack 100*a* and/or the second stackable rack 100*b*, and one or more rails 126*a* and 126*b* positioned on the bottom surfaces 106 of the first stackable rack 100*a* and/or the second stackable rack 100*b*. The one or more rails 126*a* and 126*b* positioned on the bottom surface 106 of the second stackable rack 100*b* may be inserted into and slidably received within the one or more channels 124*a-b* positioned on the top ceiling 104 of the first stackable rack 100*a*.

In some implementations, the first stackable rack 100*a* and/or second stackable rack 100*b* may each have one or more rails 126*a* and 126*b* positioned on the top ceilings 104 of the first stackable rack 100*a* and/or the second stackable rack 100*b*, and one or more channels 124*a* and 124*b* positioned on the bottom surfaces 106 of the first stackable rack 100*a* and/or second stackable rack 100*b*.

In some implementations, the first stackable rack 100*a* may have a channel and a rail positioned on the top ceiling 104 of the first stackable rack 100*a* and the second stackable rack 100*b* may have a rail and a channel positioned on the bottom surface 106 of the second stackable rack 100*b*, to couple the bottom surface 106 of the first stackable rack 100*a* and the top ceiling 104 of the second stackable rack 100*b*. In other implementations, the first stackable rack 100*a* may have a channel and a rail positioned on the bottom surface 106 to couple the stackable rack 300 to another stackable rack. In other implementations, the second stackable rack 100*b* may have a channel and a rail positioned on the top ceiling 104 to couple the stackable rack 300 to another stackable rack.

In some implementations, due to the differing size and/or shape of the first stackable rack 100*a* and the second stackable rack 100*b*, the one or more interlocking devices may be positioned differently on the top ceiling 104 and/or bottom surface 106 of the first stackable rack 100*a* and/or the second stackable rack 100*b*. For example, the first stackable rack 100*a* that stores one or more vial boxes 102 may have a wider width than the width of the second stackable rack 100*b* that stores one or more cassettes 122. And so, the one or more interlocking devices may be positioned with a larger offset from the one or more edges of the first and second sidewalls 108, 110 of the first stackable rack 100*a* than the offset of the one or more interlocking devices from the one or more edges of the first and second sidewalls 108, 110 of the second stackable rack 100*b*. That is, the one or more interlocking devices of the first stackable rack 100*a* may be more centered on the top ceiling 104 and/or bottom surface 106 of the first stackable rack 100*a* than the one or more interlocking devices of the second stackable rack 100*b* when the first stackable rack 100*a* has a larger width than the second stackable rack 100*b*. This allows the one or more rails 126*a* and 126*b* and the one or more channels 124*a* and 124*b* to align on differently sized stackable racks.

The one or more channels 124*a* and 124*b* on the top ceiling 104 of the first stackable rack 100*a* may slidably receive the corresponding one or more rails 126*a* and 126*b* on the bottom surface 106 of the second stackable rack 100*b* when the second stackable rack 100*b* is positioned on top of the first stackable rack 100*a*. The one or more channels 124*a* and 124*b* on the top ceiling 104 of the second stackable rack 100*b* may slidably receive one or more rails 126 on a bottom surface 106 of a third stackable rack that may be placed on top of the second stackable rack 100*b*. The one or more rails 126*a* and 126*b* on the bottom surface 106 of the first stackable rack 100*a* may be inserted into one or more channels 124 on the top ceiling 104 of a fourth stackable rack when the first stackable rack 100*a* is placed on top of the fourth stackable rack.

FIGS. 4-5 show other combinations of the stackable racks 100 coupled together to form the rack system 300. FIG. 4 shows two stackable racks 100*a* and 100*b* that both receive, store and/or secure one or more cassettes 122. FIG. 5 shows two stackable racks 100*a* and 100*b* that both receive, store and/or secure one or more vial boxes 102. The rack system 300 may include any number of stackable racks 100 in any combination of the different types of stackable racks 100 disclosed herein to store and/or secure different or the same storage containers.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A rack system, comprising:

a first stackable rack including a top ceiling, a bottom surface, a first sidewall and a second sidewall; and a second stackable rack including a top ceiling, a bottom surface, a first sidewall, a second sidewall and a shelf, wherein the top ceiling, the bottom surface, the first sidewall, the second sidewall and the shelf of the second stackable rack define a first compartment and a second compartment, wherein the bottom surface of the first stackable rack comprises a first portion extending laterally outward past the first sidewall, and a second portion laterally outward past the second sidewall, and a portion between the first portion and second portion that is opposite the top ceiling to form an inner enclosure, provides a floor wherein the bottom surface, including the first portion and the second portion, is a single planar and continuous piece, wherein a first rail comprises a first pair of tabs that extends downwardly from the first portion in a first direction, wherein a second rail comprises a second pair of tabs that extends downwardly from the second portion in a second direction, wherein the second stackable rack comprises a first rail extending from the top ceiling adjacent to a first sidewall of the second stackable rack and a second rail extending from the top ceiling adjacent to the second sidewall of the second stackable rack, and wherein the first rail and the second rail are received into a space defined between the first pair of tabs and the second pair of tabs to couple the bottom surface of the first stackable rack with the top ceiling of the second stackable rack so that the bottom surface of the first stackable rack is coupled with the top ceiling of the second stackable rack.

2. The rack system of claim 1, wherein the first direction is a direction that is parallel to a direction of the first sidewall and the second direction is a direction that is parallel to a direction of the second sidewall, and the first direction and second direction are a same direction.

3. The rack system of claim 1, wherein the first stackable rack has a first size and a first shape and the second stackable rack has a second size and a second shape, the first size or the first shape being different than or the same as the second size or the second shape, respectively.

4. The rack system of claim 1, wherein the first or second compartment of the second stackable rack is capable of receiving a storage container through an opening of the first or second compartment.

5. The rack system of claim 4, wherein the rack system comprises disposed in the storage container.

6. The rack system of claim 1, further comprising:

a damping device positioned within the first or second compartment of the second stackable rack and configured to reduce vibration of a storage container received within the first or second compartment when the storage container is inserted into the first or second compartment through an opening of the first or second compartment.

7. The rack system of claim 6, wherein the damping device comprises a leaf spring, wherein the leaf spring is coupled to the shelf or the bottom surface of the second stackable rack and comprises a curved elongated portion that protrudes or curves into the first or second compartment and flexes or compresses to reduce the vibration.

8. The rack system of claim 1, wherein the shelf is configured to be inserted into and removed from the second stackable rack and coupled in between the first sidewall and the second sidewall at various positions to adjust a size of the first or second compartment.

9. The rack system of claim 1, wherein the second stackable rack further comprises a rear wall that extends between the top ceiling and bottom surface and includes at least one uncovered portion through which a storage container received within the first or second compartment is pushed out of the first or second compartment.

10. The rack system of claim 6, wherein the damping device is further configured to secure the storage container within the first or second compartment.

11. The rack system of claim 4, wherein the storage container is placed flatly and horizontally on the shelf.

12. The rack system of claim 4, wherein the rack system comprises a cassette disposed in the storage container.

13. A rack system, comprising:

a first stackable rack including a top ceiling, a bottom surface, a first sidewall and a second sidewall; and a second stackable rack including a top ceiling, a bottom surface, a first sidewall, a second sidewall and a shelf, wherein the top ceiling, the bottom surface, the first sidewall, the second sidewall and the shelf of the second stackable rack define a first compartment and a second compartment, wherein the bottom surface of the first stackable rack comprises a first portion extending laterally outward past the first sidewall, and a second portion laterally outward past the second sidewall, and a portion between the first portion and second portion that is opposite the top ceiling to form an inner enclosure, provides a floor wherein the bottom surface, including the first portion and the second portion, is a single planar and continuous piece, wherein a first rail comprises a first pair of tabs that extends downwardly from the first portion in a first direction, wherein a second rail comprises a second pair of tabs that extends downwardly from the second portion in a second direction, wherein the second stackable rack comprises a first rail extending from the top ceiling adjacent to a first sidewall of the second stackable rack and a second rail extending from the top ceiling adjacent to the second sidewall of the second stackable rack, and wherein the first rail and the second rail are received into a space defined between the first pair of tabs and the second pair of tabs to couple the bottom surface of the first stackable rack with the top ceiling of the second stackable rack so that the bottom surface of the first stackable rack is coupled with the top ceiling of the second stackable rack, wherein the first or second compartment of the second stackable rack is capable of receiving a storage container through an opening of the first or second compartment to be placed flatly and horizontally on the shelf, wherein the bottom surface including the first portion and the second portion extends flat and horizontally.

* * * * *